United States Patent [19]

Fischer

[11] Patent Number: 4,809,492

[45] Date of Patent: Mar. 7, 1989

[54] TORSIONALLY BALANCED WIRE ROPE OR CABLE

[75] Inventor: Helmuth Fischer, Dortmund, Fed. Rep. of Germany

[73] Assignee: Vereinigte Drahtseilwerke GmbH, Dortmund, Fed. Rep. of Germany

[21] Appl. No.: 96,032

[22] Filed: Sep. 11, 1987

[30] Foreign Application Priority Data

Sep. 13, 1986 [DE] Fed. Rep. of Germany ..... 3631211

[51] Int. Cl.[4] ..... D07B 1/06

[52] U.S. Cl. ..... 57/212; 57/215; 57/219

[58] Field of Search ..... 57/210, 212, 215, 219

[56] References Cited

U.S. PATENT DOCUMENTS

| | | | |
|---|---|---|---|
| 339,646 | 4/1886 | Hallidie | 57/215 X |
| 986,817 | 3/1911 | Gore | 57/219 |
| 2,167,098 | 7/1939 | Wells | 57/212 X |
| 3,530,661 | 9/1970 | Thomen | 57/215 X |
| 3,922,841 | 12/1975 | Katsumata et al. | 57/215 |
| 4,048,794 | 9/1977 | Falcy et al. | 57/215 |
| 4,311,001 | 1/1982 | Glushko et al. | 57/215 |
| 4,349,063 | 9/1982 | Kikuchi et al. | 57/215 X |

*Primary Examiner*—Donald Watkins

*Attorney, Agent, or Firm*—Herbert Dubno

[57] ABSTRACT

The twistless and/or weakly twisted wire rope or cable with the many strand many layer structure comprises a core rope and a cover layer stranded on the core rope in an opposite stranding direction. The core rope is made exclusively from substantially circular strands and the cover layer is made exclusively from only one layer of substantially flat strands.

8 Claims, 4 Drawing Sheets

TORSIONALLY BALANCED WIRE ROPE OR CABLE

FIELD OF THE INVENTION

My present invention relates to a twistless or low-twist wire rope or cable.

BACKGROUND OF THE INVENTION

A tensionally balanced wire rope, which can also be referred to as a twistless or weakly twisted wire rope or cable, can have a multistrand multilayer structure and can comprise a core cord and a cover layer stranded on the core cord in an opposite stranding direction.

The twistfree or weakly twisted wire rope or cable can be made from circular strands or from flat strands (cf., e.g. German Industrial Standards DIN 3051, Sheet 2, Page 2 and DIN 3070, Page 1).

In the known twist free or weakly twisted wire rope or cable either both the cover layer and the core rope are made from circular strands or the cover layer and the core rope are both made from flat strands. The wire rope or cable made from circular strands has different advantages and disadvantages from those of the wire rope formed from the flat strands.

The wire rope or cable formed from circular strands has the following advantage:

The torsion balance and flexibility may be influenced in a wide range by the number of the strand layers in the wire rope or cable and/or the number of strands per layer and by the choice of the structural form of the individual strands (according to wire number and wire strength whereby all the individual strands in the core wires are exclusively circular wires which may be steel wires of equal nominal bearing strength).

However this wire rope or cable has the following disadvantages:

Since the outer strands of the core cord and the individual cover layer strands contact each other only at points extremely high notch and transverse stresses arise.

Becauae of the positively acting large number of cover layer strands, wire rope or cable of this structure is comparatively more susceptible to mechanical damage of the wire rope or cable surface and/or thrusting of the rope core between the strands of the cover layer even with slight kinking.

The advantages of the wire rope or cable formed from the flat strands are:

Each individual strand layer provides a comparatively large and smooth surface because of the oval shape of its strand.

Because of the large-surface contact of the adjacent strand layers the contacting surface is increased and the loading force per unit area is decreased. The attained optimum adhesion friction in a grooved roller acts in a positive way particularly when the wire rope is used with a drive pulley.

The essential disadvantages of this wire rope or cable are as follows:

Because of the shell-like overlapping strand cover layers and the soft core easily deformable by radial pressure the individual strands of the wire rope or cable diameter are more than proportionally reduced during use.

Because of the oval strand shape the steel wire is subjected to a permanent nonuniform bending and torsion and these effects are further amplified during operation as a result of additional shape changes which cause further flattening of the strands.

Only a very limited cross section oriented torsion balancing between the sum of all the right and all the left strand members is possible.

The complete strength of the core cord (considering all of the strand-layer cross sections including the cover layers) is severely limited by the comparatively large strand gaps and by the core and/or shaping wires which are not load supporting. Thus the breaking strength is definitely limited.

The wire rope or cable because of its structure is comparatively stiff with respect to bending.

A wire rope or cable is known in which two outer strand layers of flat strands and an inner stand layer of circular strands are provided. This wire rope or cable however has the above named disadvantages for the wire rope or cable formed from flat strands.

OBJECTS OF THE INVENTION

It is an object of my invention to provide an improved wire rope or cable which avoids drawbacks of the prior art.

It is also an object of my invention to provide an improved wire rope or cable made of a multilayer multistrand structure.

It is another object of my invention to provide a twistfree or weakly twisted wire rope or cable.

It is a further object of my invention to provide a wire rope or cable made of a multilayer multistrand structure which has the above mentioned advantages of both of the known wire rope or cable formed from flat and circular strands but not the above mentioned disadvantages.

SUMMARY OF THE INVENTION

These objects and others which will become more readily apparent hereinafter are attained in accordance with my invention in a torsionally balanced wire rope or cable of a multistrand multilayer structure comprising a core cord and a cover layer stranded on the core cord in an opposite stranding direction.

According to my invention the core cord is exclusively made from a plurality of circular strands and the cover layer is made exclusively from a single layer of flat (oval-section) strands.

The core cord comprises a plurality of circular strands which envelop in a multilayer structure the core insert. The number and dimenson of the strands can thus be chosen over a broad range and the core insert can be formed in many different ways.

The core cord can be made with parallel stranding since wire damage can occur by overlapping the crossing individual strand layers with a core cord not made in parallel stranding. The effect of this crossing stress can only be determined by expensive test procedures.

According to additional features of the invention the core cord is surrounded by a sheath either with fiber material i.e. natural or synthetic resin or with a synthetic resin material. Appropriately the layer thickness of the fiber material and/or the man-made material is chosen so that the flat strands of the cover layer, in stranding processes or with an additional step, are firmly imbedded in the fiber material and/or the man-made material layer.

In other examples of the invention with comparatively large strand gaps in the cover layer fiber twists, e.g. of natural or man-made fiber, are costranded to fill the gaps. This type of strand gap is especially prominent in the cover layers of wire rope or cables made with a Seale-structure.

Advantageously desirable example of my invention the cover layer of the wire rope or cable has at least six and at most nine flat strands. Advantageously in this example the flat strands forming the cover layer each have two wire layers.

BRIEF DESCRIPTION OF THE DRAWING

The above and other objects, features and advantages of my invention will become more readily apparent from the following description, reference being made to the accompanying highly diagrammatic drawing in which all wire ropes are illustrated in diagrammatic section. In the drawing.

SPECIFIC DESCRIPTION

In all examples of the wire rope or cable the strands of the core cord 1 are stranded about a separately stranded wire core insert 4.

Figure 3:
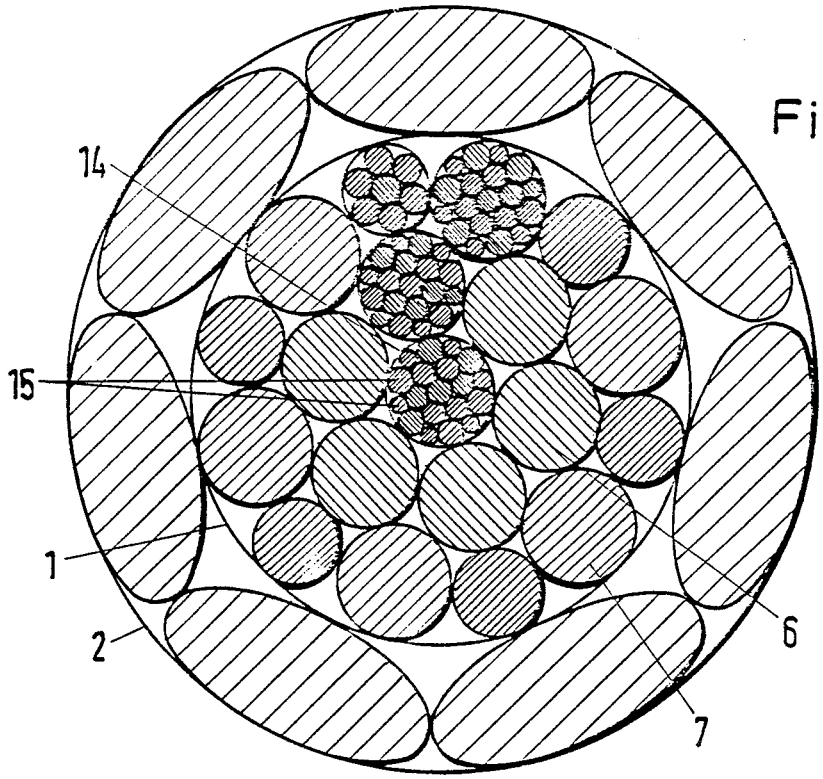
FIG. 3 is a wire rope or cable according to my invention whose core cord includes 18 strands.
Figure 4:
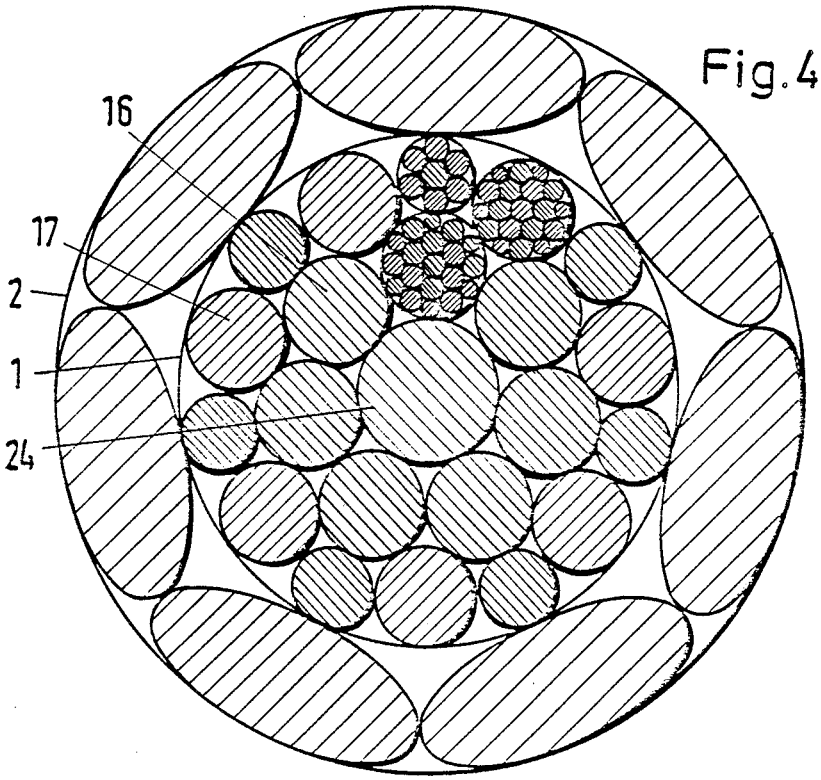
FIG. 4 is a wire rope or cable according to my invention whose core cord includes 21 strands.
Figure 5:
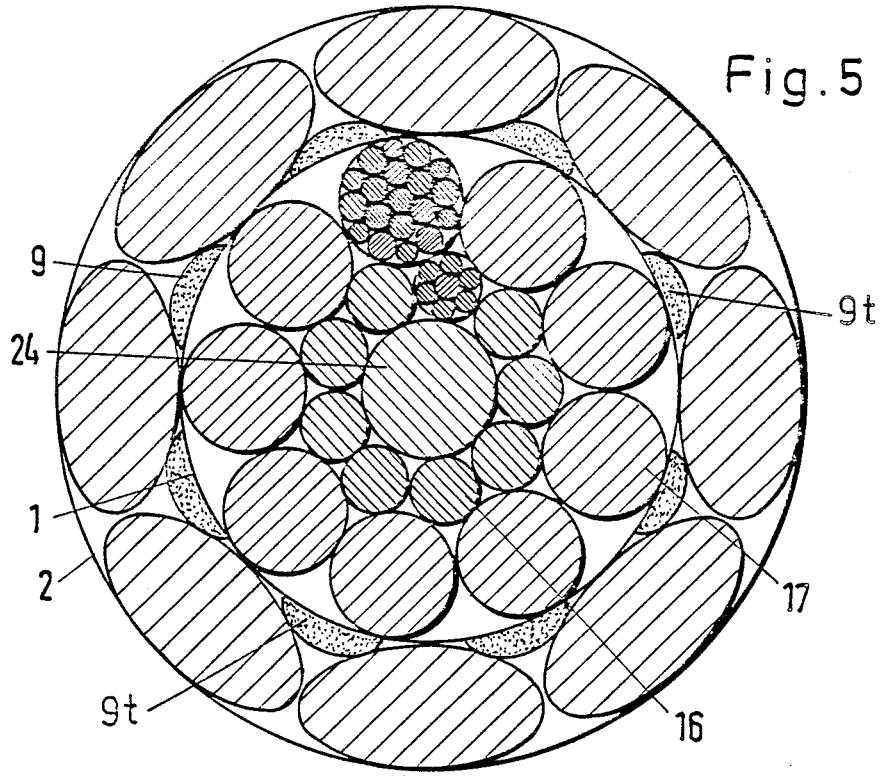
FIG. 5 is a wire rope or cable according to my invention whose core cord includes 18 strands.
Figure 6:
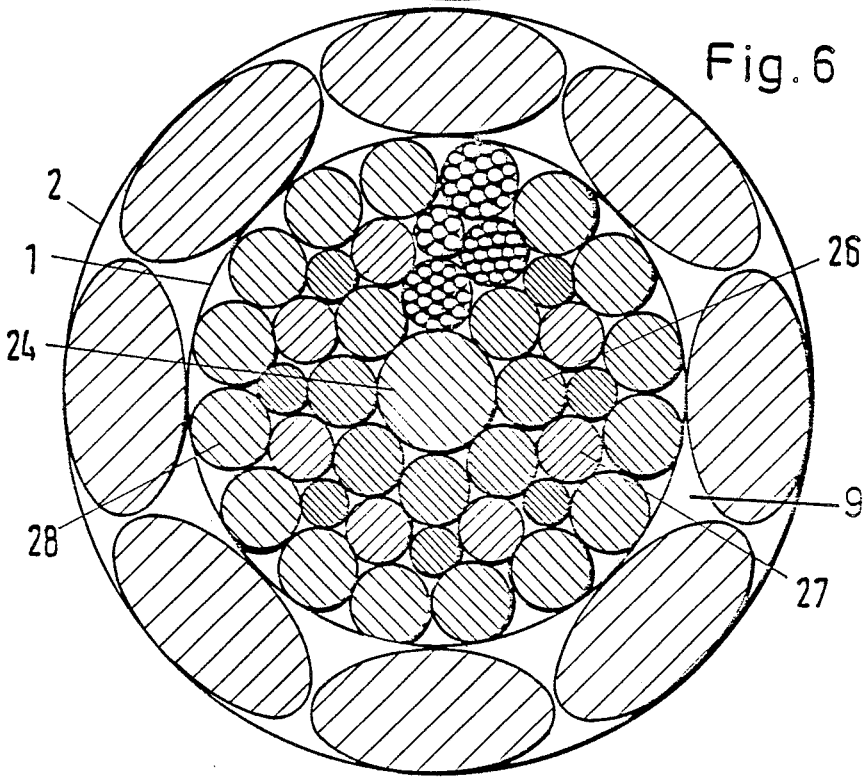
FIG. 6 is a wire rope or cable according to my invention whose core cord includes 40 strands.

The core cord 1 of the wire rope or cable shown in FIGS. 1 to 4 are manufactured in a Warrington-Structure while the core cord 1 of the wire rope or cable shown in FIG. 5 is made in the Seale-Structure and the core cord 1 of the wire rope or cable illustrated in FIG. 6 in a Warrington-Seale-Structure. The covering layer 2 of the wire rope or cable has eight (FIGS. 1 and 2 as well as FIGS. 5 and 6) or seven (FIGS. 3 and 4) flat strands 3.

Figure 1:
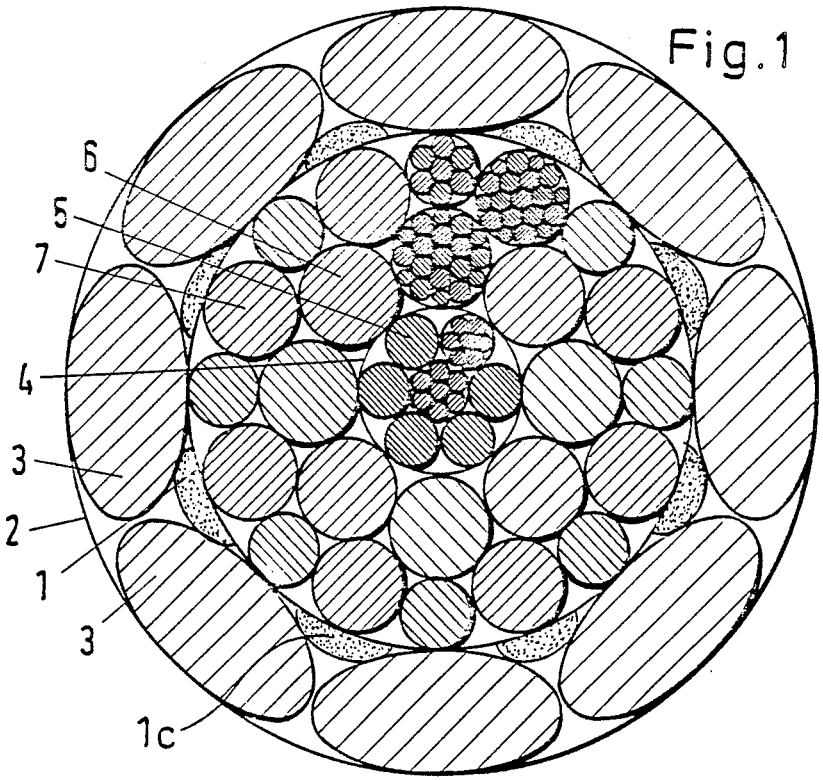
FIG. 1 is a wire rope or cable according to my invention whose core cord includes 24 strands.
Figure 2:
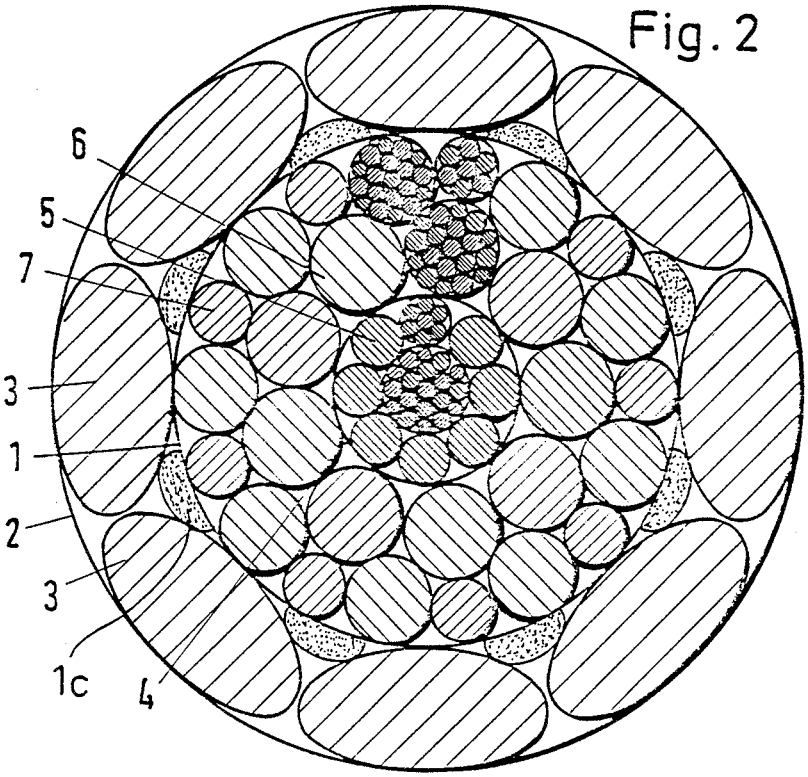
FIG. 2 is a wire rope or cable according to my invention whose core cord includes 27 strands.

In the example according to FIGS. 1 and 2 the core cord 1 is made with parallel stranding and comprises a separately stranded steel wire insert 4—SES-steel insert wire rope or cable—with seven insert strands 5 (FIG. 1) and nine strands 5 (FIG. 2) and two layers of circular strands 6 and 7.

The flat strands 3 of the cover layer 2 are imbedded in a man-made or natural fiber 1*c* which is braided or covers the core cord 1.

The core cord 1 of the wire rope or cable made with parallel stranding shown in FIG. 3 comprises a separately stranded steel insert 14—SES-steel insert strand—with nineteen wires 15 and two layers of circular strands 6 and 7.

The core cord 1 of the wire rope or cable illustrated in FIGS. 4 to 6 which are made in parallel stranding comprises a fiber insert 24 and two layers of circular strands 16 and 17 (FIGS. 4 and 5) or three layers of circular strands 26, 27 and 28 (FIG. 6). The fiber insert 24 can comprise natural or man-made material. To fill up the strand gaps 9 fiber twists 9*t* can be costranded in strand gaps 9 as seen in FIG. 5.

Figure 7:
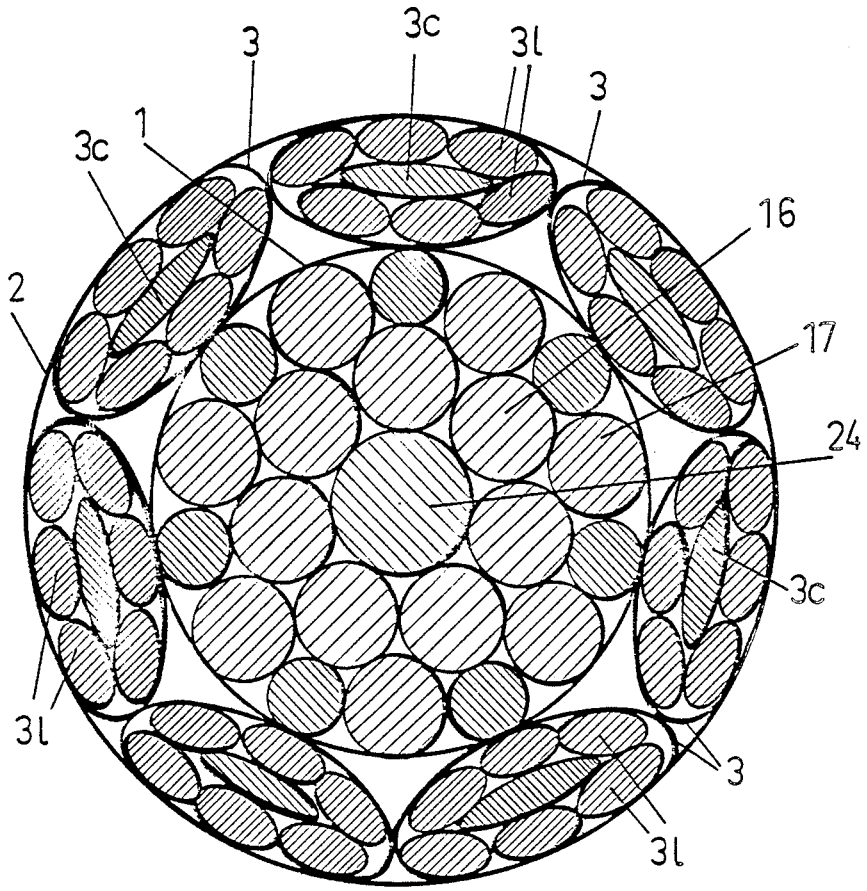
FIG. 7 is a wire rope or cable according to my invention with a cover layer whose strands have two wire layers instead of one.

FIG. 7 shows a wire rope or cable according to my invention which has two wire layers 3*c* (the central layer) and 31 in the flattened strands 3 making up the cover layer 2. In other ways this example is similar to the previous example of FIG. 4 and the same reference numbers are used for the same components.

Core cords with any other wire rope or cable structure, e.g. core cords with a filler-structure, and with any number of circular strands can be used within the framework of my invention.

I claim:

1. A torsionally balanced wire rope, comprising:

a circular cross section core cord of parallel strands having a twist in one sense, each of said strands being of a circular cross section and comprising a multiplicity of circular-section parallel wires having a twist in said one sense, the strands along a periphery of said core cord being laterally contiguous around the periphery; and a cover layer consisting exclusively of a single layer of mutually parallel substantially flat strands around and on said periphery of said core cord and having a twist in the opposite sense and arranged to torsionally balance the twist of said core cord.

2. The wire rope according to claim 1 wherein said core cord is covered or braided with a natural or man-made fiber material.

3. The wire rope according to claim 2 wherein the thickness of said natural or man-made fiber material enables said flat strands of said cover layer to be firmly imbedded in said natural or man-made fiber material.

4. The wire rope according to claim 1 wherein said core cord is wrapped with a man-made material.

5. The wire rope according to claim 1 wherein a plurality of fiber twists of a natural or man-made fiber are costranded as a filter and are received in gaps between the flat strands of the cover layer.

6. The wire rope according to claim 1 wherein said cover layer comprises at least six and at most nine of said substantially flat strands.

7. The improvement according to claim 6 wherein each of said substantially flat strands forming said cover layer have two wire layers.

8. A wire rope according to claim 1 wherein said cover layer comprises at least six and at most nine of said substantially flat strands and each of said substantially flat strands forming said cover layer has two wire layers.

* * * * *